US005448878A

United States Patent [19]

Hansen et al.

[11] Patent Number: 5,448,878

[45] Date of Patent: Sep. 12, 1995

[54] SHOCK ABSORBING SKIP SEAL MECHANISM AND METHOD FOR CONTROLLING ACTION OF A CROSS HEAD SEALER OF A SHRINK FILM WRAP MACHINE

[76] Inventors: Franck E. Hansen, 842 Merrill La., Grayslake, Ill. 60030; Edmund D. Brett, 613 Bonniebrook, Mundelein, Ill. 60060

[21] Appl. No.: 983,476

[22] Filed: Dec. 3, 1992

Related U.S. Application Data

[63] Continuation-in-part of Ser. No. 791,659, Nov. 12, 1991, abandoned.

[51] Int. Cl.[6] ..... B65B 59/02; B65B 9/06; B65B 53/06; B65B 19/34

[52] U.S. Cl. ..... 53/442; 53/450; 53/66; 53/550; 53/557

[58] Field of Search ..... 53/66, 550, 553, 51, 53/557, 371.6, 374.6, 389.3, 450, 442, 463, 466, 229

[56] References Cited

U.S. PATENT DOCUMENTS

| | | | |
|---|---|---|---|
| 2,655,777 | 10/1953 | Hagen | 53/66 X |
| 3,158,973 | 12/1964 | Monaghan | 53/66 |
| 3,237,371 | 3/1966 | Gerlach | 53/374.6 |
| 3,328,936 | 7/1967 | Billeb | 53/550 X |
| 3,438,173 | 4/1969 | Omori | 53/374.6 X |
| 3,473,288 | 10/1969 | Nakamura et al. | 53/550 X |
| 3,477,191 | 11/1969 | Davis et al. | 53/550 X |
| 3,524,301 | 8/1970 | Zimmerman | 53/550 X |
| 3,552,088 | 6/1971 | Niwa | 53/66 X |
| 3,738,081 | 6/1973 | Heinzer | 53/550 |
| 3,995,407 | 12/1976 | Segale et al. | 53/550 X |
| 4,520,615 | 6/1985 | Engler et al. | 53/550 |
| 4,549,386 | 10/1985 | Wilson | 53/550 X |
| 4,553,377 | 11/1985 | Klinkel | 53/374.6 X |
| 4,597,240 | 7/1986 | Scully | 53/66 X |
| 4,608,797 | 9/1986 | Shasbtam, Jr. et al. | 53/550 X |
| 4,783,950 | 11/1988 | Santagati | 53/66 X |
| 4,870,802 | 10/1989 | Cerf | 53/550 X |
| 4,909,356 | 3/1990 | Rimondi et al. | 53/66 X |
| 4,914,889 | 4/1990 | Francioni | 53/550 X |
| 4,924,657 | 5/1990 | Berti et al. | 53/550 X |
| 4,945,709 | 8/1990 | Cerf | 53/550 X |

*Primary Examiner*—Horace M. Culver

[57] ABSTRACT

A continuously operating machine is provided for wrapping articles with a heat shrinkable plastic film automatically and sequentially. Articles are continuously, transferred along a horizontal pathway to a plurality of processing stations. At a first station, articles are tubularly overwrapped and sealed by a lap sealer or side sealer. Next, the articles are separated one from the other at a second station and at a last succeeding station, the resulting wrapped articles are subjected to thermal film shrinking. The second station comprises a cross head sealer unit which includes a skip seal mechanism thereon for overriding mechanical synchronization of the cross head sealer to the remainder of the machine through a predetermined number of sealings, allowing for packages of greater length to be accommodated, the skip seal mechanism further including a shock absorbing subassembly for smoothing action of the cross head sealer unit, increasing functional longevity of the cross head sealer unit.

14 Claims, 6 Drawing Sheets

SHOCK ABSORBING SKIP SEAL MECHANISM AND METHOD FOR CONTROLLING ACTION OF A CROSS HEAD SEALER OF A SHRINK FILM WRAP MACHINE

CROSS REFERENCE TO RELATED APPLICATION

This application is a continuation in part of a U.S. application Ser. No. 791,659 filed Nov. 12, 1991 for Shrink Film Wrapping Machine. Ser. No. 07/791,659 has been abandoned in favor of File Wrapper Continuation Ser. No. 08/135,136.

BACKGROUND OF THE INVENTION

1. Field of the Invention

This invention relates to an improved packaging machine, especially a continuously operating machine for wrapping articles with a heat shrinkable plastic film or the like, automatically and sequentially.

More particularly the present invention relates to a shock absorbing skip seal mechanism for use in controlling action of a cross head sealer of the wrapping machine to accommodate articles of greater length than previously possible, to provide a mechanism for producing smooth action of the heads of the cross sealer, particularly at the beginning and end of each seal cycle, and to a novel method associated therewithin.

2. Description of the Prior Art

Various packaging machines for wrapping materials automatically and sequentially with heat shrinkable film are available commercially from various manufacturers. However, these machines frequently display problems in achieving synchronization between the cross head seal mechanism and the infeed conveyor, particularly when continuous operating conditions and elongated articles to be packaged are involved. Also, the machines often require frequent and time consuming maintenance and adjustment.

Further, the prior art machines commonly involve complicated procedures and significant down time to change the machine from one operating configuration to another, such as is needed when package size is changed or different bag cut-off lengths are required. Also, prior art machines utilize specialized, costly components.

Still further, prior art machines have been incapable of wrapping packages of any significant length because of mechanical operational constraints produced by the gear driven cross head sealer.

Typically, accommodation of elongated packages has been provided by speeding transport of such package through the cross head sealer station. Such speeded up transport causes stress on the other stations to maintain synchronization at a much more rapid rate of function, inasmuch as the wrapping is a continuous sheet of material until it is severed into packages by the cross head sealer.

As will be described in greater detail hereinafter, the shock absorbing skip seal mechanism of the present invention allows the remaining stations of the packaging machine to operate at optimum speeds and to accommodate elongated packages by maintaining the cross seal heads separated for a specific number of sealing cycles to accommodate a lengthy package, the skip seal mechanism further providing shock absorbing structure for the heads so that they start up and stop smoothly at each seal cycle, decreasing concussive forces and thereby increasing functional longevity.

SUMMARY OF THE INVENTION

According to the invention there is provided apparatus for continuously wrapping articles comprising:

(a) conveyor means for transporting a plurality of like articles along a generally horizontal path with predetermined spacing between longitudinally adjacent successive articles;

(b) a first station along the path having means for continuously forming a longitudinally extending tubular overwrap circumferentially about the articles from a continuous film as the articles pass through the station and including means for adhering edge portions of the overwrap in an area adjacent each of the articles and trimming away excess film as necessary; and (c) a second station along the path having means for cross sealing and separating the tubular overwrap between adjacent successive articles the second station including means thereon for overriding mechanical synchronization between the first and second stages to cause skipping of a predetermined number of cycles thereof to accommodated elongated packages.

Further according to the invention there is provided a shock absorbing skip seal mechanism for use in a continuously operating wrapping machine wherein articles being wrapped are first sequentially and longitudinally overwrapped with a continuous film, the unit comprising an incremental rotation control package including a wrap spring clutch therein which is intermittently activated to drive a drive rod powering said second station.

Still further according to the invention there is provided a method for shrink film wrapping of elongate articles in an apparatus comprising:

(a) conveyor means for transporting a plurality of like articles along a generally horizontal path with predetermined spacing between longitudinally adjacent successive articles;

(b) a first station along the path having means for continuously forming a longitudinally extending tubular overwrap circumferentially about the articles from a continuous film as the articles pass through the station and including means for adhering edge portions of the overwrap in an area adjacent each of the articles and trimming away excess film as necessary; and (c) a second station along the path having means for cross sealing and separating the tubular overwrap between adjacent successive articles the second station including means thereon for overriding mechanical synchronization between the first and second stages to cause skipping of a predetermined number of cycles thereof to accommodated elongated packages; the method including the steps of:

placing a plurality of similar elongate articles upon the conveyor;

having the articles pass through the first station at a predetermined speed;

having the articles pass through the second station at an identical predetermined speed;

and producing in the second station mechanical override of synchronized mechanical function as it relates to said first station by causing skipping of a predetermined number of cycles to accommodate elongate packages.

DESCRIPTION OF THE PREFERRED EMBODIMENT

Figure 1:
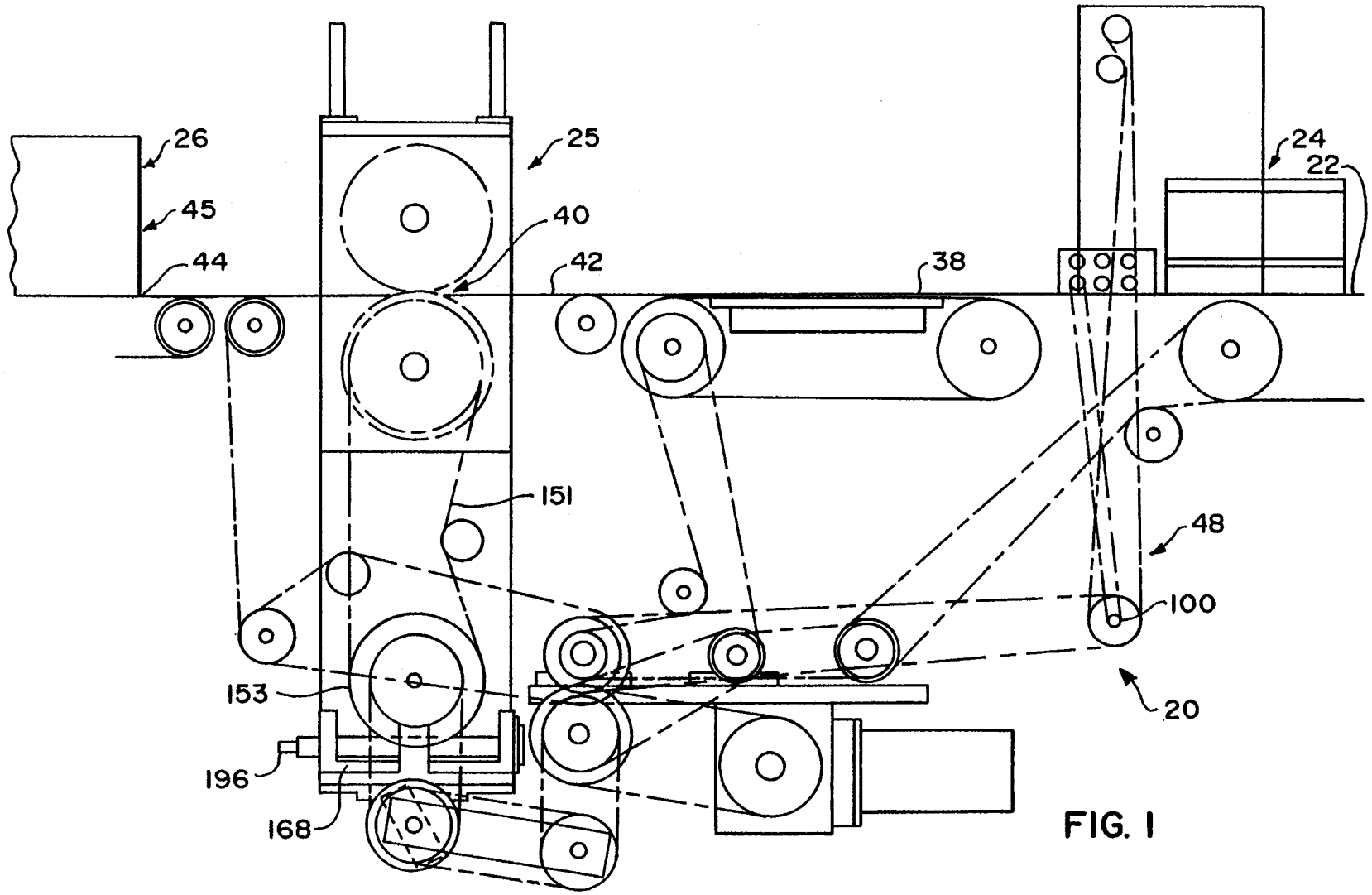
FIG. 1 is a partial diagrammatic side elevational view of one embodiment of a shrink film wrapping machine of this invention.
Figure 2:
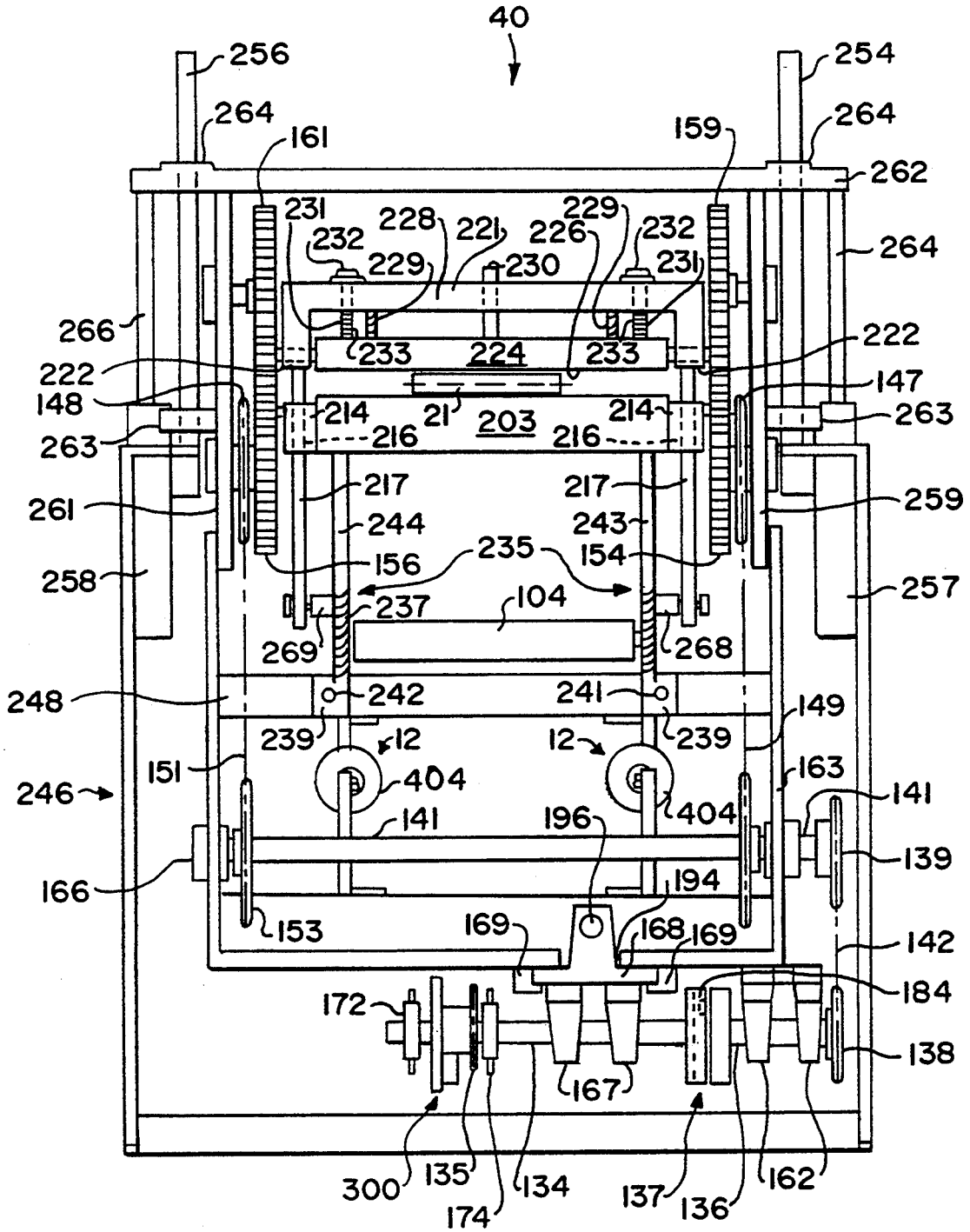
FIG. 2 is a transverse cross sectional view through a cross head seal and cut assembly of a packaging machine and shows the skip seal mechanism and shock absorbing subassembly therein.

Referring to the Figures in greater detail there is illustrated therein a section of one embodiment of a shrink film wrapping machine of the present invention designated in its entirety by reference numeral 20.

In machine 20, packages, articles or objects that are being wrapped continuously and sequentially are moved horizontally along a conveyor pathway which extends through three successive stationary processing stations 24, 25 and 26. Thus, a plurality of similarly sized objects which are to be individually wrapped by machine 20 with a heat shrinkable film are sequentially deposited upon the input end of an endless conveyor 22, conveyor 22 continuously operating and advancing to the left in FIG. 1, moving to the first processing station 24.

First processing station 24 is provided for longitudinally and continuously overwrapping successive objects with a film overwrap 27 having a tubular configuration. The tube center region encompasses the articles therein which are to be sealed into packages.

Thus, as each article moves through station 24, it becomes wrapped in a manner where free side edges of the film to be sealed to one another meet and lie along a side edge of the articles when a side seal mechanism is provided or is wrapped in a manner to form a bottom seal adjacent the article when a lap sealer mechanism is provided. Inasmuch as it is proposed to use either a side sealer or a lap sealer at station 24, for the sake of brevity, the description will be limited to use with a side seal mechanism at station 24. The film is preferably comprised of a thermally shrinkable polymeric material.

In station 24, free opposite side edges of the film tube are brought together by a plow arrangement so that the edges lie along the side edge of the articles being wrapped. The edges are then thermally interfacially bonded together so as to hold the coplanar edges of the formed film tube closed and together with material excess being cut away to form a clean side seal.

As each thus wrapped article leaves station 24, it is engaged by a continuously advancing conventional type vacuumized endless belt conveyor 38. Preferably, belt conveyor 38 is provided with a plurality of closely spaced apertures that extend therethrough. Thus, the wrapped articles are held in fixed position relative to one another upon an upper surface of belt conveyor 38. Also the vacuum provides the force to pull and move the wrapped articles from station 24 to the next processing station 25.

From a tail end of belt conveyor 38, each object is transferred to a conveyor 42 which commences in adjacent, longitudinally spaced relationship to belt conveyor 38. Conveyor 42 moves the articles continuously through station 25 wherein a cross head sealer and cutter unit 40 operates continuously.

In cross head sealer and cutter unit 40 operation, first a forward end of the tube surrounding each article is cut and heat fused. Then, as each resulting individual article continues its advance on the belt conveyor 42 the rearward or trailing end of each such bag being formed is cut and heat fused, thereby completing formation of a packaging bag about each article.

The cutting and heat fusing preferably takes place along a line which extends transversely across the belt conveyor 42 and is mid-way between each pair of successive longitudinally spaced article on the belt conveyor 42. Preferably also, this line is mid-way between the top and the bottom ends of each pair of successive articles.

From station 25 and belt conveyor 42, each now completely bagged article is advanced and is transferred to an endless belt off-feed transfer conveyor 44 which is longitudinally spaced from but in adjacent relationship with belt conveyor 42. Conveyor 44 in embodiment 20 is a linking conveyor which functions to deliver wrapped and sealed articles to a station 26 where a continuously operating shrink tunnel 45 is situated. Each article emerging from tunnel 45 is completely packaged within a heat shrunk side sealed, trimmed film package.

Packaged articles 32 upon reaching the end (not shown) of belt conveyor 44 are collected for storage, subsequent further bulk packaging, shipment, or the like, as desired.

The machine 20 incorporates a drive subsystem 48 which causes the conveyors, the film wrapper, the side seal and trim unit 50 at station 24, and the cross head sealer and cutter 40 at station 25 to operate synchronously with each other. The drive subsystem 48 is illustrated in FIG. 1 and is described in detail in U.S. patent application Ser. No. 791,659, the teachings of which are incorporated herein by reference.

Such machine 20 has, because of mechanical linkages described above, had a restriction on the length of packages 21 which can be accommodated by the cross head seal unit 40.

In this respect, because mechanical synchronization was heretofore provided by speeding up of the conveyor belt 42 feeding the unit 40, with the unit 40 timely functioning upon each rotation of drive shaft 134 therefor, a limit was necessarily placed upon the length of a package 21 which could be "shot" through within a given time period between unit 40 activations.

As will be described in greater detail hereinafter, the shock absorbing skip seal assembly 10 of the present invention was developed to allow the unit 40 to "skip" a chosen number of mechanical seal cycles so that packages of a significantly longer length could be accommodated without "shooting" through the unit 40.

With the addition of the skip seal assembly 10, packages of elongated configuration may be processed by the unit 40 by creation of skipped sealing cycles, as desired, at a travel rate synchronized to that of the rest of the machine 20 components, relieving stress thereon.

Further, it has been found that if the activation of and stopping of the cross head seal unit 40 sealing cycle were smoothed out, rather than jolting on and off, greater longevity of useful life of the unit 40 would be obtained. Thus the skip seal assembly has incorporated therein a shock absorbing subsystem 12 which acts in cooperation therewithin to cause a smooth operation of the unit 40.

To provide an overview of the manner in which the unit 40 operates, the following description is supplied.

In cross head 40 operation, first the forward end of the bag surrounding each object 21 is cut and heat fused. Then, as each resulting individual object 21 continues its advance, the rearward or trailing end of each such bag is cut and heat fused, thereby completing formation of a packaging bag about each object 21. The cutting and heat fusing preferably takes place along a line which extends transversely across the direction of travel of the belt conveyor 43 and is mid-way between each pair of successive longitudinally spaced objects 21 on the belt conveyor 43. Preferably also, this line is mid-way between the top and bottom ends of each pair of the longitudinally spaced successive objects 21.

Such a preferred spatial location for this seal and cut line is achieved for individual objects 21 by settings of machine 20 adjustments which, in accord with a particular feature of this invention, are relatively simply and quickly accomplished. Also, adjustments in synchronization and in timing of infeed conveyors relative to cross head 40 operation are similarly readily accomplished.

The cross head subassembly 40 includes a rotating knife 224 and a synchronously rotating lower bar 203. Each has a rotating pivot joint at each end thereof that is mounted eccentrically to rotating gears. The gears are cantilevered on outboard bearing housings mounted to frame walls 259 and are driven by chains 149 and 151 that are timed to the flighted infeed conveyor 22. The knife 224 and the lower cross bar 203 rotate with an orbital motion and are held parallel relative to each other by a set of slide bearings 214 that are associated with rods 217 that are preferably comprised of hardened and ground steel. The sealing surfaces of knife 224 and bar 203 come into contacting engagement with one another as platens, thereby sealing the trailing end of one package and the leading end of the next one while concurrently cutting the two apart, all in the same orbital motion.

The overwrapped packages are successively translated through the cross head subassembly 40 on conveyor 43 while utilizing the rotary motion of the cross head subassembly 40 and coordinated oscillating shifting of upper surface portions of the conveyor 43. The conveyor 43 is thus kept evenly spaced between the rotating knife 224 and bar 203. This oscillating conveyor 43 is powered by the drive subsystem 48 and always stays in the same top plane as the top of the vacuumized conveyor 38.

To transfer power to cross head sealer and cutter 40, the sprocket 59 on shaft 57 is utilized to drive a first sprocket 128 that is mounted on transfer shaft 129 by means of an interconnecting roller chain 131. Then, a second sprocket 132 that is also mounted on transfer shaft 129 is utilized to drive delivery shaft 134 through an interconnecting roller chain 135. Rotational power is transferred from delivery shaft 134 to receiving shaft 136 through a pause cam subassembly 137 (whose structure is hereinafter described). The receiving shaft 136 has mounted thereon a sprocket 138 that is utilized to transfer power to a sprocket 139 that is mounted on a cross shaft 141 by means of an interconnecting roller chain 142. Thus, rotation of shaft 136 causes rotation of shaft 141.

Rotatably mounted in fixed coaxial but axially spaced relationship to one another is a first pair of stub shafts 143 and 144, each shaft 143 and 144 being journaled on a different opposed side of the cross head 40 using the frame assembly 146 of cross head 40 for support. Each stub shaft 143 and 144 is in generally vertically spaced, parallel relationship to cross shaft 141, and each stub shaft 143 and 144 has mounted thereon a sprocket 147 and 148 respectively. Each sprocket 147 and 148 is rotatably driven by roller chain 149 and 151, respectively. Each roller chain 149 and 151 is engaged also with a respective one of a pair of aligned coplanar driving sprockets 152 and 153 which are both mounted on a cross shaft 141. Tension on each respective roller chain 149, 151 is conveniently regulated by an associated sprocket 95 (paired). Mounted in opposed relationship to one another adjacent the inner end of each stub shaft 143 and 144 is a respective one of a pair of drive gears 154 and 156, respectively.

Rotatably mounted in fixed coaxially spaced relationship to one another is a second pair of stub shafts 157 and 158, each shaft 157 and 158 being journaled on a different side of the cross head 40 using the cross head frame assembly 146. Each stub shaft 157 and 158 is in vertically equally spaced, parallel relationship to the adjacent respective one of the stub shafts 143 and 144. Mounted in opposed relationship to one another adjacent the inner end of each stub shaft 157 and 158 is one of a pair of driven gears 159 and 161, respectively. Each of driven gears 159 and 161 is in engaged relationship with its adjacent drive gear 154 and 156, respectively. The interrelationship between the gears 159 and 154 and the gears 161 and 156 is such that all of shafts 143 and 157, and 144 and 158, respectively, rotate at the same speed (or rpm). Thus, power is transferred to cross head sealer and cutter 40 from motor 50.

The operation and functional effect of the pause cam subassembly 137 is readily understood in that the shaft 136 is supported and journaled by a pair of bearing pillow blocks 162 which are both fixedly held and supported in coaxial aligned relationship to each other at a bottom corner portion of the U-configured carriage member 163 of frame assembly 146 of cross head 40. Shaft 141 is rotatably journaled at its respective opposite ends by bearings 164 and 166 in respective opposed side portions of U-configured carriage member 163 and is in generally vertically spaced, parallel relationship to shaft 136. Sprockets 138 (on shaft 136) and 139 (on shaft 141) are in vertically spaced, coplanar relationship for mutual engagement with common roller chain 142.

The shaft 143 is supported and journaled by a pair of pillow blocks 167 which are both fixedly held and supported in coaxial aligned relationship to each other by a platform slide 168. A pair of opposed supporting guides 169 are provided. The base of each guide 169 is mounted to a bottom facial portion of the U-configured carriage member 163 so that each guide 169 is in transversely spaced relationship relative to the other thereof and so that together the guides are adapted to hold slidably the slide 168 so that the shaft 134 as held by pillow blocks 167 is in end adjacent, parallel relationship relative to the shaft 136 with a coaxial relationship between shafts 134 and 136 being achieved at one position of slide 168. Thus, longitudinal reciprocal sliding movements of slide 168 within the guides 169 cause movement of shaft 134 into and away from coaxial alignment with shaft 136.

The end region 176 of shaft 134 has mounted therein the sprocket 133. On each side of sprocket 133 on shaft 134 one end of a lever arm pair 174 is journaled by a bearing 171 (paired). The relationship between shaft 134 and its associated components is such that, for example shaft 134 can be laterally displaced from a position that is coaxial with shaft 136 without appreciable coaxial (relative to shaft 134) displacement of shaft 134 in either of its longitudinal directions. The result is that shaft 134 can be axially offset relative to shaft 136 with shafts 134 and 136 being parallel to one another.

The opposite end region 177 of shaft 134 has mounted thereon a rectangular plate 178 which has an elongated shallow cavity 179 formed therein. The cavity 179 extends radially outwardly and is diametrically perpendicular relative to the axis of shaft 134. Cavity 179 is axially open forwardly towards the adjacent end region 181 of shaft 136. Cavity 179 has along each of its longitudinal sides a forwardly extending shoulder 182.

The adjacent end region 181 of shaft 136 has mounted thereon a rectangular plate 183 which has a diametrically extending flattened forward end face, and a post or cam follower 184 projects axially forwardly therefrom (relative to the axis of shaft 136) in radially spaced relationship to the axis of shaft 136.

When shafts 134 and 136 are in their assembled configuration as shown, the forward region of cam follower 184 on plate 183 is received in cavity 179 and thus is engaged with plate 178. Thus, when shaft 134 is coaxial with shaft 136, the shaft 136 turns uniformly with the shaft 134 at the same constant rotational speed as that at which the shaft 134 is rotatably driven. However, when the end 177 of shaft 134 is radially displaced from such coaxial configuration by slidably moving slide 168 along guide 169, then the speed of rotation of shaft 136 during each revolution thereof varies even though the speed of rotation of shaft 134 remains constant. Such rotational speed variation of shaft 136 is caused by the fact that the post 184 moves in an eccentric manner about the axis of the shaft 134. When, compared to the coaxial configuration, the radial distance of the post 184 relative to the axis of shaft 134 is shortened, then the shaft 136 turns at a slower speed (instantaneous rpm) than the instantaneous rpm of shaft 134 (which is substantially constant). On the other hand when this radial distance from shaft 134 axis to path of the post 184 is lengthened, then the shaft 136 turns at a higher instantaneous rpm than the instantaneous rpm of shaft 134. Hence, this arrangement of shafts 134 and 136, their respective plates 178 and 183, and their associated components, provides in combination a capacity for varying the speed of shaft 136 during each revolution thereof relative to shaft 134. This eccentric linkage arrangement is termed a pause cam herein.

For purposes of regulating the position of the slide 168 (and the position of shaft 134), the slide 168 has fixed thereto an upstanding projection 193 that extends through a transversely extending elongated slot 194 which is formed in the bottom of the U-configured carriage member 163. Projection 193 has a transversely extending threaded tap hole 196 formed therein which is threadably received around elongated screw member 197 which extends longitudinally (relative to machine 20) across the upper face of the bottom of the U-configured carriage member 163. Respective opposite end regions of screw member 197 are journaled for screw member 197 rotational movements by bearings 198 (paired) that are associated with respective support posts 199 that the upstand from association with opposite edges of carriage member 163. Thus, screw member 197 holds slide 168 and turning of screw member 197 adjusts the position of shaft 134 (and its associated components) relative to the shaft 136 as desired.

To overcome the potential problem of distance change between axis of coplaner sprockets associated with roller chains in the region of shaft 134 (which would, for example, interfere with and even prevent power transfer when the shaft 134 is offset relative to shaft 136), two pairs of pivotably joined pivoting arms 186 and 174 are provided for pause cam assembly 137. Thus, one end 187 of each arm pair 186 is pivotably connected to shaft 57 whose rotational axis is fixed by pillow block 192 or the like to frame 146.

The opposite end of 188 of each arm 186 is rotatably connected to shaft 129 and also is pivotably connected to one end 191 of each arm 174. The other end 189 of each arm 174 is rotatably connected to shaft 134, as above described. Thus, arms 186 maintain a fixed distance between sprocket 59 mounted on shaft 57 and sprocket 128 mounted on shaft 129 when such are interconnected by a roller chain 131, and arm 174 maintain a fixed distance between sprocket 132 mounted on shaft 129 and sprocket 133 mounted on shaft 134 when such are interconnected by a roller chain 135, even when the spatial location of the shafts 129 and 134 is changed when the slide 168 is transversely moved causing shaft 134 to be moved.

Each of the gears 154 and 156 is provided with a stub crank shaft 201 and 202 respectively and each such shaft is journaled with respect to its respective associated gear 154 and 156 for rotational movements (by bearing means not detailed). Each crank shaft 201 and 202 is displaced an equal radial distance from the axis of its associated gear. Transversely between the gears 154 and 156 on the opposed respective end portion of each shaft 201 and 202 is suspended the assembly of a lower cross bar 203.

At each of its opposite ends, the cross bar 203 is provided with a liner bearing 214 (paired). Each bearing 214 is conventionally associated (means not shown) with a different opposite end of the cross bar 203 therebetween. Each crank shaft 201, 202 is then conventionally connected (means not shown) to the outside end of a different bearing 214 for purposes of suspending the cross bar 203 between shafts 201 and 202. The bearings 214 each have a bearing channel 216 therein which extends perpendicularly relative to cross bar 203 and also to axis 213 and which is oriented perpendicularly to the upper face 225 of lower cross bar 203. Slidably extended through each channel 216 is a guide rod 217 (paired) for achieving sliding reciprocal movements of each rod 217 relative to each associated channel 216.

Each of the gears 159 and 161 is similarly provided with a spur crank shaft 218 and 219 which is similarly journaled in its respective associated gear 154 and 156 for rotational movements. Each crank shaft 218 and 219 is likewise displaced an equal radial distance from the axis of its associated gear. The gears 159 and 161 are equal in radial size to the gears 154 and 156 and the radial spacing of all crank shafts 201, 202, 218 and 219 from the axis of its associated gear is equal.

Transversely between the gears 159 and 161 on the opposed respective end portion of each shaft 218 and 219 is suspended an upper cross bar 221. At each of its opposite respective ends the cross bar 221 is provided with a side projecting integral extension 222 (paired) which is perpendicular to the main body 228 of cross bar 221. At a location adjacent the outside terminus of each extension 222, a different one of each shaft 218 and 219 is connected in opposed relationship relative to the other thereof so the main body of cross bar 221 extends horizontally. From the outside terminus of each extension 222 extends a guide rod 217, each rod 217 being spaced, parallel relationship relative to the other. Each rod 217 extends through a different channel 216 of a bearings 214. Thus, when the adjacent gears 154 and 159 and 156 and 161, respectively are engaged, and sprockets 147 and 148 are rotated, each of the upper and lower cross bars 221 and 203 pursues an orbital cylindrical path. Each cross bar 221 and 203 is maintained in a fixed vertical relationship relative to the other by the sliding engagement of the rods 217 with respect to cross bar 203 and its bearings 214.

The upper transversely extending surface of the lower cross bar 203 has mounted thereon a layer 223 of a resilient elastomeric material, such as a rubbery polymer or the like. Depending downwardly from the main body 228 of the upper cross bar 221, and extending generally between the paired extensions 222, is a transversely elongated package end forming seal bar or knife 224.

Here, knife 224 along its bottom has tapered side walls which conveniently and preferably terminate in a relatively dull pointed transversely uniform edge 226. Interiorly, an electric resistance heater 227 is provided in adjacent relationship to edge 226 which is thermostatically controlled so as to provide the capability for achieving and maintaining a preferably substantially uniform heating of edge 226.

Figure 3:
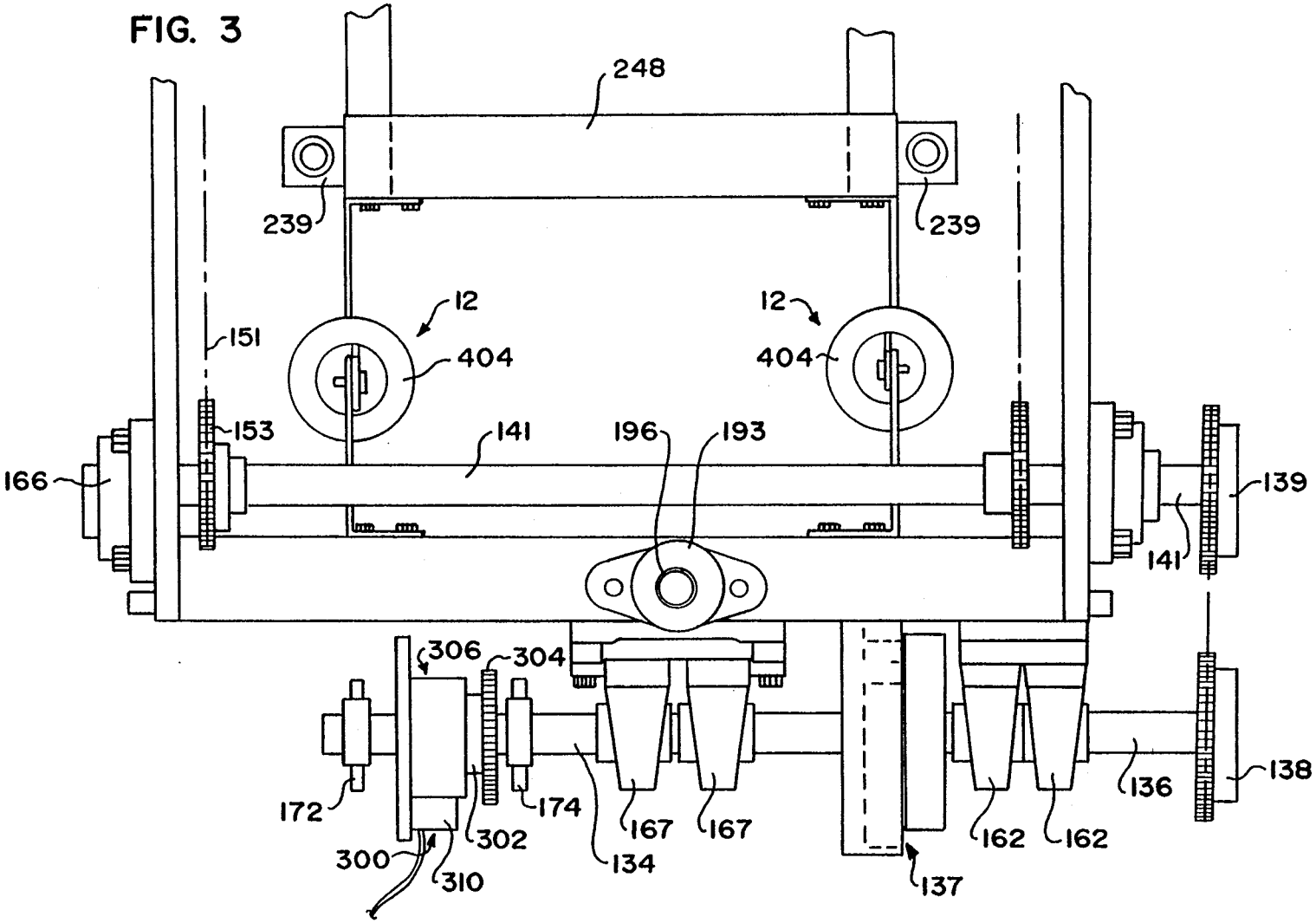
FIG. 3 is an enlarged view of a portion of FIG. 2 showing the skip seal mechanism and shock absorbing subassembly.
Figure 4:
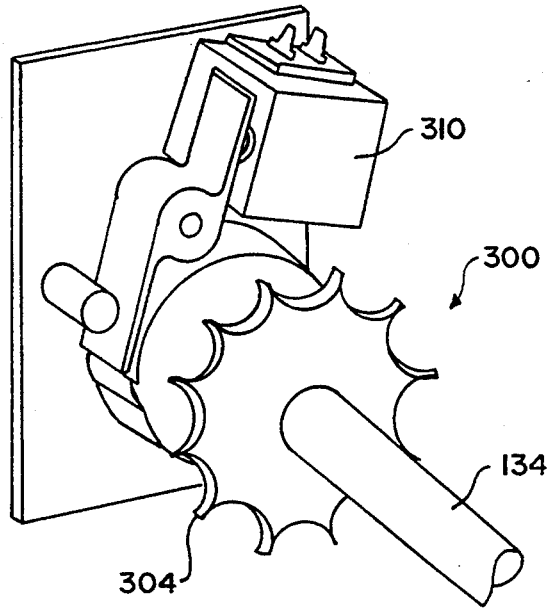
FIG. 4 is a perspective view of a modified incremental rotation control package used in controlling skipping of cycles by the cross head sealer.

Knife 224 along its upper transversely extending surface is provided with a plurality of transversely spaced, upstanding guide rods, such as side pins 229 and elongated center pin 230, which are slidably received in clearance channels (not shown) formed in the main body 228 of cross bar 221. To maintain the knife 224 in a vertically spaced relationship to the main body 228 of cross bar 221, a pair of larger sized (relative to pins 229) guide rods 231 are provided, each one thereof being located adjacent a different opposite end of knife 224, and each rod 231 is terminally threaded and provided with a washer equipped nuts 232 for holding these rods 231 in a fixed extended association relative to the main body 228 of a cross bar 221. Also, these rods 231 are each provided with a circumferentially located coiled compression spring 233 (paired) which yieldingly bias the knife 224 in an extended configuration relative to the main body 228, Such as illustratively shown in FIG. 3 for example. Compression springs 233 are also provided about pins 229 for such biasing. Thus pressure exerted on the edge 226 causes the retraction of knife 224 towards main body 228 of cross bar 221.

As the gear pairs 154/159 and 156/161 revolve, each gear revolution involves a cycle wherein the knife 224 and the cross bar 203 are first brought into a position of contacting engagement one with the other, and then those components are moved in respective cylindrical paths into a position of maximum separation therebetween. Actual cutting of film 27 typically and preferably does not occur. Rather, the heat associated with knife 224 is used to locally melt and sever film 27 positioned between knife 224 and bar 203. The contact time between film layers 27 and the registered knife 224 and bar 203 is adjusted so as to be sufficient to achieve the desired combination of sealing and severance (cutting) in any given operational mode.

A plurality of rollers are mounted to a carriage subassembly that is designated in its entirety by the numeral 235 and that is comprised of a pair of spaced, parallel side plates 236 and 237 and also a pair of cross members 238. The base of each plate 236 and 237 is associated with a pair of bearing blocks 239 which are each preferably provided with liner bearings. The bearing blocks 239 that are associated with plate 236 are slideably mounted on a horizontal shaft 241, and the bearing blocks 239 that are associated with plate 237 are slidably mounted on another horizontal shaft 242. Shafts 241 and 242 are in spaced parallel relationship to each other, and are each associated at their respective opposite ends with adjacent fixed portions of frame 146. Thus, the carriage 235 is reciprocally slidable on shafts 241 and 242.

Each side plate 236 and 237 has a vertically oriented slot 243 and 244, respectively, formed therein, and each slot is open at its upper end. The width of each slot 243 and 244 is sufficient to accommodate the width of the lower cross bar 203. The distance between plates 236 and 237, is such that the plates 236 and 237 extend lower cross bar 203 so that each plate 236 and 237 is adjacent a different respective opposite end of bar 203 (adjacent the bearing blocks 214). As a consequence, when lower cross bar 203 follows its cylindrical orbit as engaged gears 154 and 156 revolve, the cross bar 203 moves in an oscillating manner upwards and downwards in each of the slots 243 and 244 in noncontacting relationship. Transversely outwardly extending from and mounted to the outside of each plate 236 and 237 is a linear bearing block 268 and 269, respectively. Each of the respective guide rods 217 extends through a different linear bearing of one block 268 and 269. Thus, as the gears 159 and 161 revolve, the guide rods slidably move up and down in the bearing blocks 268 and 269. In addition, the plates 236 and 237 are concurrently moved slidably along the shafts 241 and 242. As a consequence, the carriage 235 oscillates in a left/right side to side direction and in a vertical direction by the guidance produced through the association with rods 217.

To achieve the capacity for centering the engaged region between knife 224 and lower cross bar 203 relative to objects 21 of a series thereof, the frame assembly 146 of cross head sealer and cutter 40 is comprised of an outer fixed support frame 246 and an interior adjustable support frame 247. Outer frame 246 includes a transverse base support 248, and a pair of spaced, parallel side walls 249 and 251 each of which terminates in an inturned top flange 252 and 253, respectively. A rod 254 and 256 upstands, each in spaced parallel relationship relative to the other, from an inside edge of each flange 252 and 253.

A pair of fluidic cylinders 257 and 258, each preferably pneumatic, is provided, each one having its cylinder body associated with a different side wall 249 and 251 in the region of the respective flanges 252 and 253 through each of which each cylinder body projects. The piston 264 and 266 of each cylinder 257 and 258 upwardly extends in spaced parallel relationship relative to the other thereof.

All moving and associated components of the cross head sealer and cutter 40 are associated with the interior adjustable support frame 247 which includes the U-configured carriage member 163 and its cross supports 248 to which opposite ends of shafts 241 and 242 are secured, a pair of spaced parallelupper side walls 259 and 261 which are each affixed at their respective lower end portions to a different one of the respective upper side portions of carriage member 163, and a top cross plate 262 which extends transversely over and across the upper edges of the upper side walls 259 and 261. In effect, interior frame 247 is suspended relative to outer frame 246 by plate 262. Mating apertures (not detailed) in plate 262 allow slidable extension of rods 254 and 256 therethrough. Additional guidance and stabilization of interior frame 247 relative to outer frame 246 is provided by transversely outwardly extending ears 263 (paired) affixed to opposite outside faces of each upper side wall 259 and 261. Each ear 263 is provided with an aperture which permits aligned engagement thereof with rods 254 and 256. Linear bearings 264 (paired) are preferably associated with plate 262 for the rods 254 and 256.

The end of each piston 264 and 266 abuts the undersurface of plate 262 adjacent a different opposed outside edge thereof. Thus, actuation of cylinders 257 and 258 causes vertical elevation or lowering, as desired, of plate 262 and the entire interior frame with its associated components. Such vertical movements do not disrupt the power transfer arrangements hereinabove described because, as described above in relation to the pause cam subassembly 137, the pivotally interconnected arms 174 and 186 and their associated drive transfer members, simply pivot as such vertical movements occur.

Since the bottom surface of each object 21 is always resting on the same plane in wrapper 20, an increase in product height requires an adjustment of the vertical position of the cross head seal subassembly 40 at which sealing occurs to achieve, for example, as preferred, a cross seal approximately half way up the height of the product. Such an adjustment of package cross seal height is accomplished by raising the cross head 40 interior frame 247, which is built as a modular system relative to the conveyors 22 and 38, with the use of cylinders 258 and 257 that are conveniently activated by a hand operated pump (not shown) or the like. The entire cross head subassembly 40 associated with interior frame 247 slides freely up and down on four externally mounted rods 254.

As indicated above, longitudinally longer objects previously required higher film 27 velocities than shorter objects, since the rotational velocity of the knife 224 and the lower cross bar 203 in cross head 40 was directly proportional to machine feed speed.

As will be described in greater detail hereinafter, the shock absorbing skip seal mechanism 10 provides a means for controlling activation of the knife 224 and cross bar 203 while maintaining constant feed speed. Further, to increase longevity of the cross head subassembly 40, by smoothing operation thereof upon start up and stopping the shock absorbing mechanism 12 of the present invention is also proposed.

Turning now to FIG. 2–6 there is illustrated therein the skip seal mechanism 10 of the present invention together with the shock absorbing mechanism 12 of the present invention used therewith.

As described, activation of the cross head subassembly or unit 40 is driven by action of rod 134 working through pause cam subassembly 137 to intermittently drive driven shaft 136.

Thus, if one were to propose modification to timing of each activation, such control would best be applied here via rod 134 activation, at the source of activation. Accordingly, it is proposed to engage a solenoid operated incremental rotation controller 300 onto the rod 134, the controller being a modified version of the CB-6 Model S Incremental Control Package made by the PSI Division of Warner Electric of Pitman, N.J.

The CB-6 Model S Control Package 300 includes therein an antiback spring which maintains single direction motion. This antiback spring must be removed creating the device shown in FIG. 6 to allow reverse "inching" operation when necessary to remove a jam from within the unit 40.

The control package 300 includes an input hub 32 to which a drive sprocket 304 may be mounted. Within the control package 300, a wrap spring clutch 306 is provided which is mounted to driven shaft 134, the clutch 306 locking the sprocket 304 to the shaft 134 for a single rotational cycle when a solenoid 310 of the control package 300 is activated. Conversely, during periods of no solenoid activation, the shaft spins freely, with the pause cam remaining in a disengaged state.

Mechanical engagement of the control package to the drive system 48 is provided by engagement of the chain drive 135 to the drive sprocket 302. As the sprocket is continuously turned by the drive chain 135 which is synchronized with the remainder of the machine 20, it was necessary to find a means by which the sprocket 304 could freely spin with only intermittent engagement being produced between the sprocket 304 and the shaft 134, thus creating "skipped" cycles of the unit 40.

Figure 7:
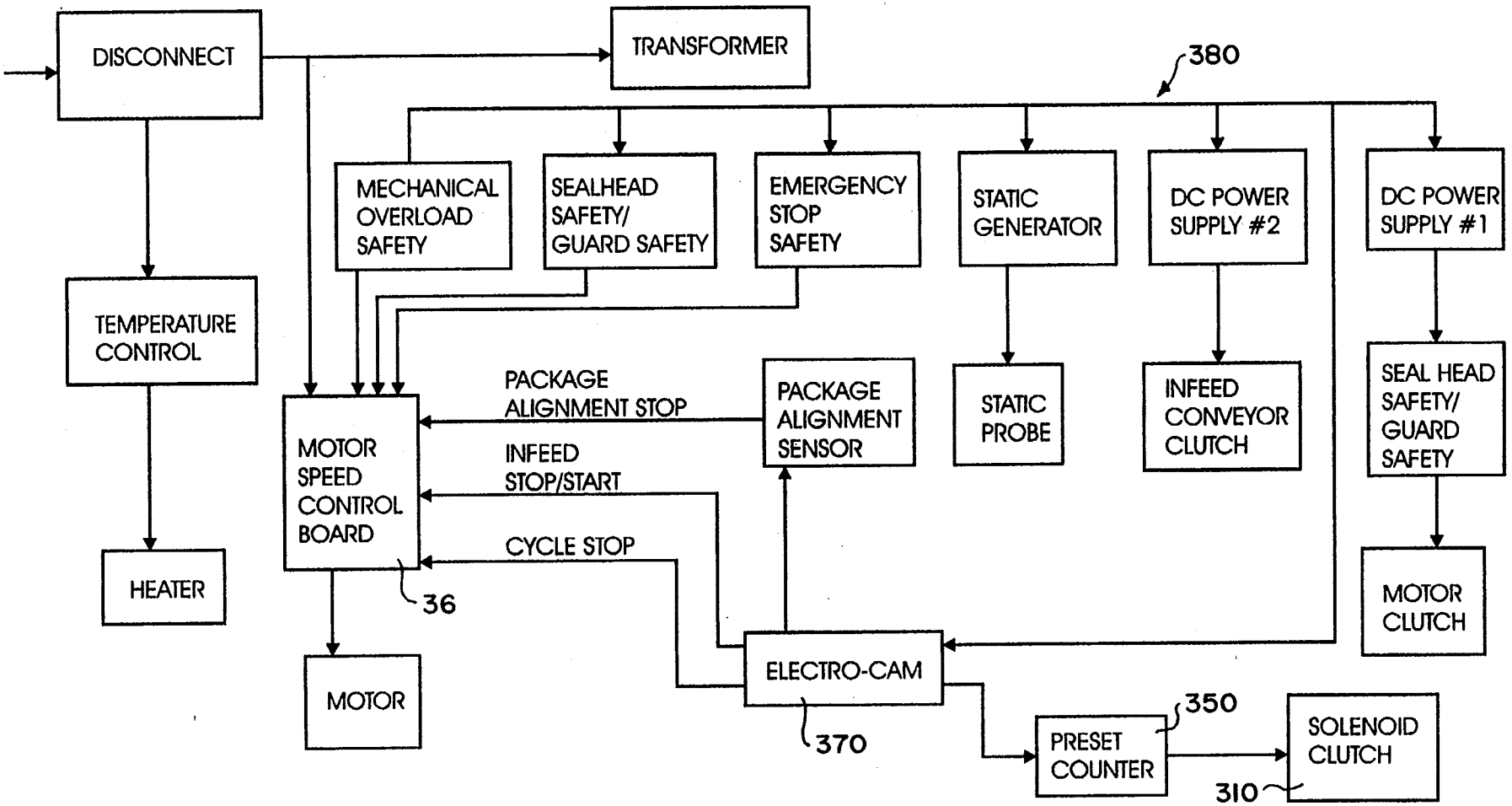
FIG. 7 is a simplified block diagram of the electrical system for the packaging machine including circuitry therein for control of the operation of the skip seal mechanism for the cross head sealer.

The number of cycles to be skipped between activations may be controlled by provision of a preset counter 350 which is, as shown in FIG. 7, incorporated into a control system 380 of the machine 20. This counter is electrically engaged to the solenoid 310 of the control package 300 and, when a selected number of rotations of sprocket 304 are counted, energizes the solenoid 310 to cause a single activation of the heads of the unit 40, hence the name skip seal assembly 10.

The counter 350 may be electronically engaged to a control board 360 for the machine 20 by suitable means such as a solid state rotary cam limit switch 370.

Figure 5:
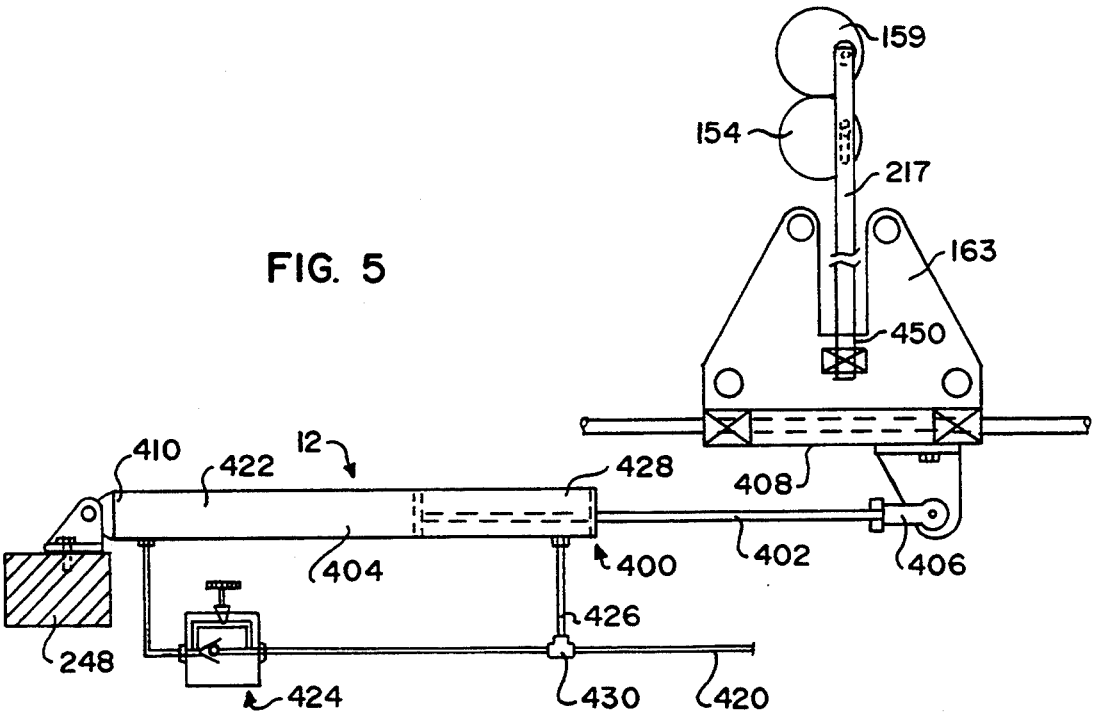
FIG. 5 is an exploded view of the components creating the modified incremental control package.
Figure 6:
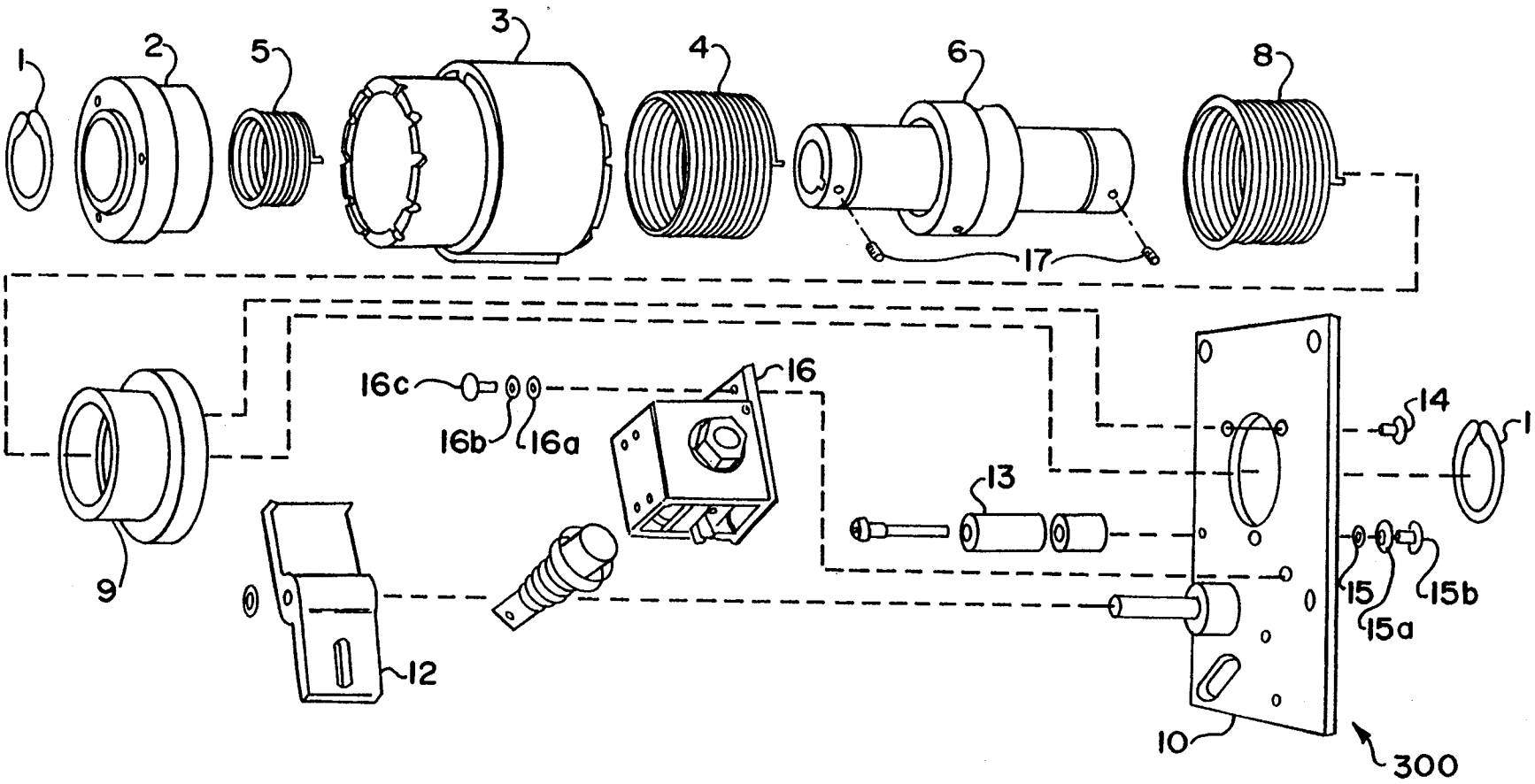
FIG. 6 is a side view showing the shock absorbing system for use in smoothing operation of the cross head sealer.

Turning now to a study of the shock absorber subassembly 12 used with the skip seal mechanism 10, the shock absorbing subassembly 12 is seen to include two pistons and cylinder arrangements 400, one being provided for and engaged to each carriage member 163. As best illustrated in FIG. 5, the arrangement 400 includes a piston 402 which is slidingly engaged within a cylinder 404. A free end 406 of piston 402 is connected in suitable manner to an underside 408 of the carriage member 163 and a free end 410 of the cylinder 404 is connected in suitable manner to a frame member 248 of the machine 20.

An air supply 420 is provided for feeding air into the cylinder 404.

Air is fed constantly to each end of the cylinder 404 from a common supply 420, with the air fed into a piston extending end 422 of the cylinder 404 passing first through a metering device 424 which is manually adjustable to provide desired metered air flow into the end 422 while allowing fee exhaust flow therethrough.

A secondary air feed line 426 is provided which feeds air into a piston engaging end 428 of the cylinder 404 via a T valve 430 engaged with a line of supply 420.

Because of an inherent difference of area of the two sides of the piston 402 and because of the presence of the piston rod 440, a constant and predictable extension bias is produced, with adjustment of the metering device 424 providing effective shock absorption, and creating an air spring effect.

Smoothing of the limits of back and forth travel of the carriage member 163 inherently smoothes out beginning and ending of sealing cycles of the knife 224 against the cross bar 203 because of the constant alignment maintained therebetween by the rod 217, a lower end 450 of which engages slidingly within a linear bearing on the carriage member 163.

Because the rod 217 is maintained vertical at all times and its lateral position relative to the rotational position of the gear pairs 154, 159 and 156, 161 constrained by the engagement of the rod end 450 within the linear bearing on the carriage member 163.

Thus, at the beginning and end of the cycles, smoothing of the carriage member 163 motion will also smooth start up and stopping of the gear rotation, creating an essentially shock free operation of the cross head sealer unit 40.

By eliminating the jolting empirically incurred without the shock absorbing subassembly, longevity of useful life of the unit 40 is significantly increased, minimizing downtime due to unit 40 failure.

As defined above, the skip seal mechanism 10 and shock adsorbing subassembly 12 thereof provide a number of advantages, some of which have been described above and others of which are inherent in the invention.

Also, modifications may be proposed to the structures disclosed without departing from the teachings herein. Accordingly the scope of the invention is only to be limited as necessitated by the accompanying claims.

We claim:

1. Apparatus for continuously wrapping articles comprising:

(a) conveyor means for transporting a plurality of like articles along a generally horizontal path with predetermined spacing between longitudinally adjacent successive articles;

(b) a first station along said path having means for continuously forming a longitudinally extending tubular overwrap circumferentially about said articles from a continuous film as said articles pass through said station and including means for adhering edge portions of said overwrap in an area adjacent each of said articles and trimming away excess film as necessary; and (c) a second station along said path having means for cross sealing and separating said tubular overwrap between adjacent successive articles said second station including means thereon for overriding mechanical synchronization between the first and second stages to cause skipping of a predetermined number of cycles thereof to accommodate elongated packages.

2. The apparatus of claim 1 further including a third station along said path having means for subjecting each said successive separately packaged article to predetermined elevated temperatures so that said film is heat shrunk about each said article.

3. The apparatus of claim 2 wherein said first station comprises a side seal and trim unit which is vertically and horizontally adjustable to rest alongside articles passing through said station, a seal mechanism thereof being approximately centered along a thickness of the articles.

4. The apparatus of claim 3 wherein said means for overriding mechanical synchronization between said first and second stations comprise an incremental rotation control package including a wrap spring clutch therein which is intermittently activated to drive a drive rod powering said second station.

5. The apparatus of claim 4 wherein said wrap spring clutch is engaged by a solenoid activator.

6. The apparatus of claim 5 wherein said solenoid activator is activated by a preset counter, the counter being under control of solid state rotary cam limit switch which synchronizes station function via an electronic relay logic controller microprocessor of the machine.

7. The apparatus of claim 6 wherein said second station further includes a shock absorbing subassembly therein for smoothing rotational operation of said cross sealing and separating means.

8. The apparatus of claim 7 wherein said cross sealing and separating means comprise a pair of driven aligned and separable rotating members, alignment rods for the rotating members engaging at one end thereof a reciprocating movable carriage in a manner to be maintained vertical at all times through a rotational cycle of said rotating members at another end thereof being rotatably fixed to one of said pair of rotating members and being fixed to another of said rotating members by a linear bearing having a channel therein through which the rod extends, the liner bearing being rotatable relative to said rotating member to which it is mounted, and reciprocating motion of said carriage being provided with a shock absorbing subassembly which smoothes out jolting incurred upon start up, stopping or reversal of direction of carriage motion, carriage member traveling back and forth once through each rotational cycle of said rotating members.

9. The apparatus of claim 8 wherein said shock absorbing subassembly comprises a pair of pneumatic piston and cylinder assemblies, a free end of piston thereof being engaged to said carriage member and a free end of a cylinder thereof being engaged to a frame member of said wrapping apparatus.

10. The apparatus of claim 9 wherein a continuous metered flow of air is provided to a frame engaging end of said cylinder for causing a predetermined length of piston extension.

11. The apparatus of claim 10 wherein said metered flow of air is manually adjustable.

12. The apparatus of claim 11 wherein a continuous secondary flow of air is provided to an end of said cylinder from which a rod of said piston extends.

13. The apparatus of claim 2 wherein said first station comprises a lap seal unit.

14. A method for shrink film wrapping of elongate articles in an apparatus comprising (a) conveyor means for transporting a plurality of like articles along a generally horizontal path with predetermined spacing between longitudinally adjacent successive articles;

(b) a first station along said path having means for continuously forming a longitudinally extending tubular overwrap circumferentially about said articles from a continuous film as said articles pass through said station and including means for adhering edge portions of said overwrap in an area adjacent each of said articles and trimming away excess film as necessary; and (c) a second station along said path having means for cross sealing and separating said tubular overwrap between adjacent successive articles said second station including means thereon for overriding mechanical synchronization between the first and second stages to cause skipping of a predetermined number of cycles thereof to accommodated elongated packages; said method including the steps of:

placing a plurality of similar elongate articles upon said conveyor;

having said articles pass through said first station at a predetermined speed;

having said articles pass through said second station at an identical predetermined speed;

and producing in said second station mechanical override of synchronized mechanical function as it relates to said first station by causing skipping of a predetermined number of cycles to accommodate elongate packages.

* * * * *